United States Patent [19]

Murata

[11] 4,233,681

[45] Nov. 11, 1980

[54] ELECTRONIC TIMEPIECE

[75] Inventor: Masami Murata, Suwa, Japan

[73] Assignee: Kabushiki Kaisha Suwa Seikosha, Tokyo, Japan

[21] Appl. No.: 974,467

[22] Filed: Dec. 29, 1978

[30] Foreign Application Priority Data

Dec. 29, 1977 [JP] Japan ..... 52-159316

[51] Int. Cl.[3] ..... G04B 19/06; G04B 19/24

[52] U.S. Cl. ..... 368/242; 368/29; 368/3 D; 368/71; 368/83; 368/84; 368/239

[58] Field of Search ..... 58/4 R, 23 R, 38 R, 58/38 A, 50 R, 57.5, 58, 85.5, 127 R, 148–152 R

[56] References Cited

U.S. PATENT DOCUMENTS

Re. 29,250 6/1977 Tanaka ..... 58/4 A 3,630,015 12/1971 Lehovec ..... 58/50 R

*Primary Examiner*—Edith S. Jackmon

*Attorney, Agent, or Firm*—Blum, Kaplan, Friedman, Silberman & Beran

[57] ABSTRACT

An electronic timepiece having liquid crystal or light-emitting diode display elements provides a logic network for flickering a part or all segments of the display element at a plurality of repetition rates and duty cycles, whereby additional intelligence associated with the repetition rate and duty cycle is conveyed by the display element. The logic network gives priority of display to any one preselected supplemental flickering intelligence function when there is a coincident demand for more than one supplemental function for display. Flickering draws attention to the supplemental intelligence contained in an otherwise continuous display.

13 Claims, 7 Drawing Figures

FIG. 1a
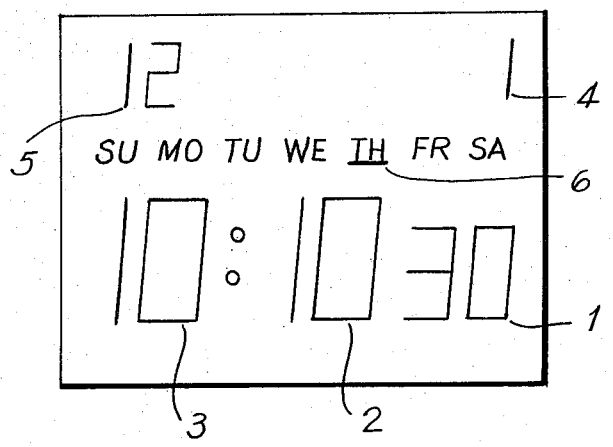
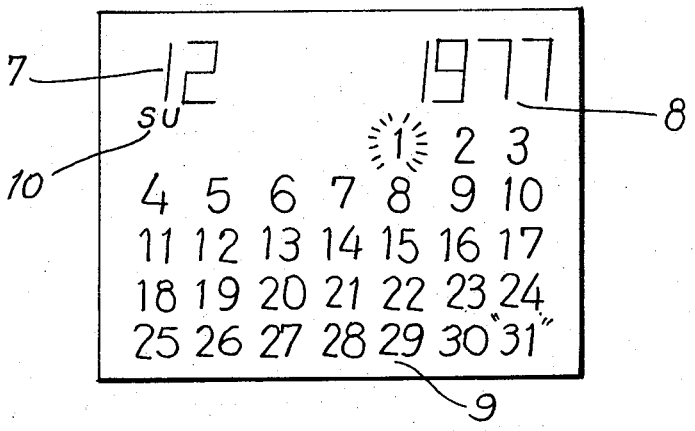
FIG. 1b

ELECTRONIC TIMEPIECE

BACKGROUND OF THE INVENTION

This invention relates generally to an electronic timepiece having a liquid crystal or light-emitting diode display element and more particularly to an electronic timepiece wherein supplemental intelligence is conveyed by flickering at a predetermined repetition rate and duty cycle of all or part of the display. Because later models of electronic timepieces are designed to perform an ever greater number of functions, there is a correspondingly increasing necessity to find means to display this increasing amount of information. It is well known that liquid crystals and light emitting diodes, arranged in segments, are used for purposes of display in electronic wristwatches. However, to display the ever-increasing number of additional functions by means of additional segments forming additional characters or marks, would increase the number of electrodes and make the display elements very large in size. So, in such a straightforward method of display, namely, adding segments, there is a practical physical limitation to the amount of additional information which can be displayed in a wristwatch. In some electronic wristwatches of the prior art, additional information, other than the information which is normally displayed by particular segments, is displayed by flickering of the segments at regular intervals and with a predetermined duty cycle. For example, in an electronic timepiece using a battery as the power source, the entire display repeatedly flickers at regular intervals to indicate the condition of the battery. Displaying information by an on-off flickering of the segments is much more conspicuous to the eye of the user than is displaying continuously by continuously driving the segments. Therefore, a flickering display is effected for the conveyance of information which is desirably displayed in a special, noteworthy manner. Unfortunately, the flickering techniques of the prior art have added only one additional bit of information to an existing display.

What is needed is an electronic timepiece which can display at least three information functions using a single display element, which without flickering would normally provide only one information function.

SUMMARY OF THE INVENTION

Generally speaking, in accordance with the invention, an electronic timepiece which is especially suited to distinguishably display at least three information functions on a single display element is provided. The electronic timepiece of this invention has at least a single liquid crystal or light emitting diode display element and provides a logic network for flickering a part or all segments of selected display element at a plurality of repetition rates and duty cycles whereby additional intelligence associated with the repetition rate and duty cycle is conveyed by each display element. At least two repetition rates for flickering of the display elements is provided. The logic network gives priority of display to any one preselected supplemental flickering intelligence function when there is a coincident demand for more than one supplemental function to be displayed. Flickering draws attention to the supplemental intelligence contained in the otherwise continuous display.

In an embodiment of this invention which is described herein as an example of the flickering apparatus for displaying supplemental functions, the present day flickers on a display which shows a calendar for the present month, and any specially selected day, for example, the user's birthday, is flickered on the calendar for the month containing the birthday. The repetition rate of flickering and the duty cycle ratio of ON time and OFF time during the flickering differ so as to distinguish visibly between the functions. This technique of displaying different kinds of information by means of a plurality of flickering modes is referred to as the multi-flickering mode.

There are several limiting factors to the application of the multi-flickering mode, namely, the response time of the display element itself and the nature of man's vision. Especially when liquid crystals are used in the display element, it is difficult to distinguish respective flickering modes because of the slow response, on/off, of the liquid crystals. If the response of the element is slow, the display actually flickers noticeably later than the occurrence of the ON or OFF signal applied to the display element. Therefore, it becomes difficult to distinguish the flickering modes when the periods or the duty cycles are similar for different intelligence functions. For this reason, it is necessary to establish clear cut differences between respective periods or duty cycles in different flickering modes. However, because of the visual response of a man's eye, only flickering repetition frequencies up to several hertz at the highest can be used. Furthermore, it is desirable that the duty cycle should have the display element ON for more than one-half of the flicker cycle, that is to say, the driving time for the display segments should be longer than the non-lit undriven period of time. Nevertheless, the number of segments in the display element can be decreased, or at least not increased in displaying additional information functions, although as indicated above the number of flickering modes is limited. The number of electrodes which are required in the display element are limited or decreased correspondingly when the flickering technique is used, but an eye-catching, conspicuous display is obtained.

Another difficulty which is avoided by the multi-flickering techniques of this invention is that which occurs when two kinds of information simultaneously require the illumination of one or more of the same segments in the display element. In such a case, because two flickering modes cannot be displayed satisfactorily at the same time, one flickering mode is given priority and selected in preference to the other. The preferential order of priority is a matter of design choice determined in view of the importance contained in each information function. The multi-flickering mode is highly effective in decreasing the number of segments and electrodes required to display a plurality of information functions. Also a conspicuous and well designed display for additional intelligence functions is provided without the need for additional display segments and electrodes.

Accordingly, it is an object of this invention to provide an electronic timepiece which displays a plurality of intelligence functions on a single display element.

Another object of this invention is to provide an electronic wristwatch which uses individual segments of the display element to convey a plurality of intelligence functions.

A further object of this invention is to provide an electronic timepiece which provides for flickering modes in the display element in order to provide a plurality of intelligence functions for display.

Still another object of this invention is to provide an electronic timepiece which displays different intelligence functions by means of flickering.

Yet another object of this invention is to provide an electronic wristwatch using flickering segments with differing flicker repetition rates and duty cycles to convey different intelligence functions.

Another object of this invention is to provide an electronic timepiece which presents supplemental intelligence functions for display without the addition of segments to the display element.

Still other objects and advantages of the invention will in part be obvious and will in part be apparent from the specification.

The invention accordingly comprises the features of construction combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1*a* is the face of an electronic timepiece of this invention showing the time-telling mode of display;

FIG. 1*b* shows the timepiece of FIG. 1*a* in the calendar mode of display;

DESCRIPTION OF THE PREFERRED EMBODIMENTS

Figure 2:
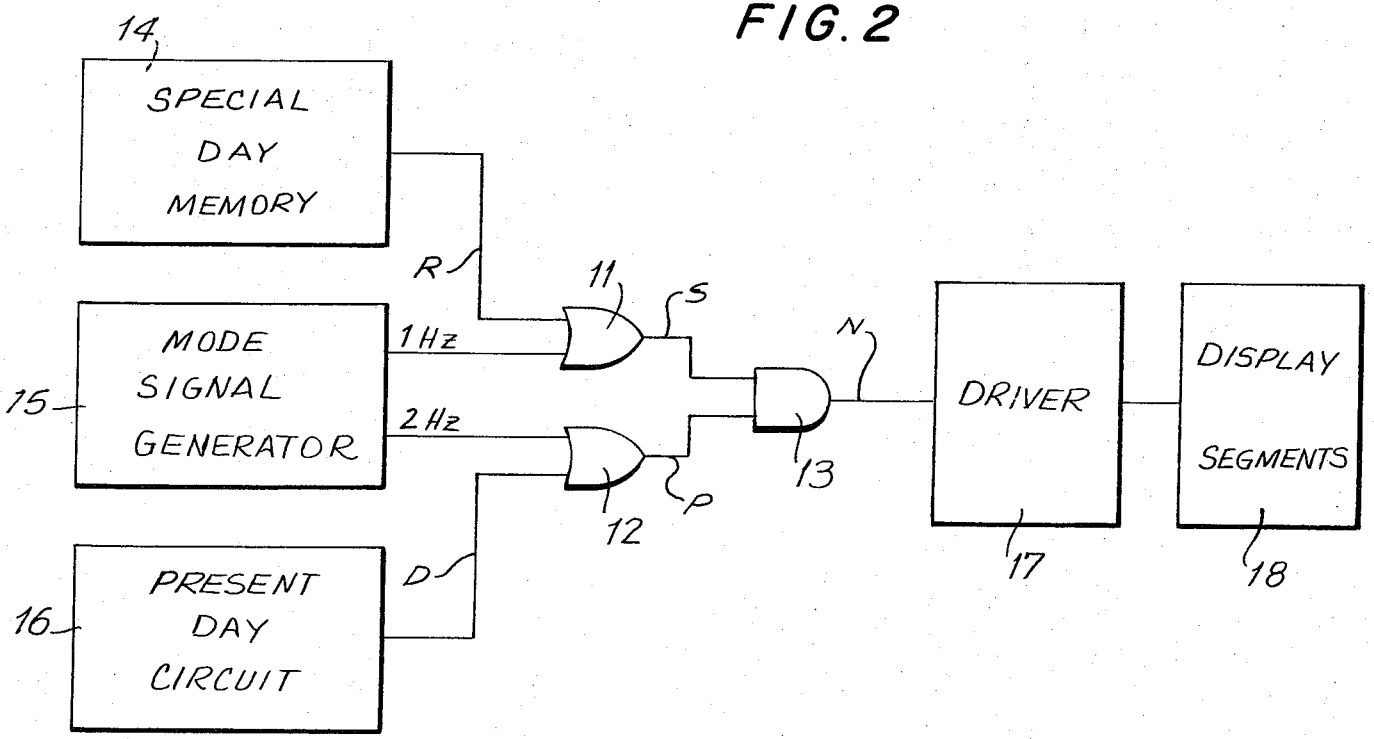
FIG. 2 is a functional diagram including logic for providing signal priority when coincident signals are directed to the display segments of a single day.

FIGS. 1*a* and 1*b* show the displays of an electronic timepiece having a double layer liquid crystal panel, that is, two liquid crystal display elements are joined back to face. Except when driven, the electrodes and the liquid crystal segments which make up the display element are invisible. Accordingly, either of the two display elements can be individually driven and appear for display without any visual interference from the other display element which is not driven. FIG. 1*a* shows the front panel in a purely timekeeping or timepiece mode. FIG. 1*b* shows the back panel in the calendar mode. Accordingly, in its simplest form the electronic timepiece can show either the time in its fullest sense or display a calendar for the month.

In the timepiece mode, the front panel, and therefore the electronic wristwatch, displays by driving its segments the following parameters: seconds 1, minutes 2, the hour 3, the date 4, the month 5, and the day of the week 6. Except for the day of the week, all of the information is displayed in number format. Letters are used to display days of the week. In the calendar mode, the front panel displays the month 7, the year 8, an entire one-month calendar 9, and an indication of Sunday 10 on that calendar. Except for the indication of Sunday 10, all information on the panel is in number format. It is not uncommon in electronic wristwatches that the monthly calendar is available for any month within a period of several decades. These are displayed by using an externally operated signalling means. Also electronic wristwatches now contain programmable memories in which data selected by the user of the watch can be stored. For purposes of illustrating the electronic timepiece of this invention, it is considered that the user of the wristwatch can store optional days in the memory, for example, a birthday, a wedding anniversary and the like. This information is put into storage by external operating means. Hereinafter, the day which is placed into storage is referred to as a specially selected day. After the specially selected day has been stored in the memory, the segments for the number indicating that specially selected day will flicker repeatedly with a certain frequency and duty cycle when the front panel is in the calendar mode. Thus, by flickering, the specially selected day is indicated and distinguished over the other information shown in the calendar. For example, in FIG. 1*b*, if December 31 is stored in the memory as the specially selected day, the segments of the display element constituting the number "31" flicker continuously at a repetition rate of one hertz and with a duty cycle of $\frac{7}{8}$, that is the number 31 is illuminated $\frac{7}{8}$ of the cycle and is OFF for $\frac{1}{8}$ of the cycle.

Also for the sake of the example, if the front panel of FIG. 1*a* is actually indicating the present month and day, that is, in the example it is the first day of December, then when the calendar of the present month is displayed in the calendar mode as shown in FIG. 1*b*, then the present day, i.e., the first day of the month, is displayed by repeatedly flickering in a mode which is distinctly different from the mode for the display of the specially selected day. In the case where the present day is December 1, the segments of the display element for displaying a "1" flicker with a repetition rate of 2 hertz and with a duty cycle of $\frac{1}{2}$. That is, the number 1 is illuminated for one-half of the cycle and is OFF for one-half of the cycle. The specially selected day and the present day can thus be simultaneously displayed in two entirely different flickering modes, which are readily distinguishable to the user.

It is noteworthy to consider what is accomplished by the application of different flickering modes to convey the additional intelligence functions. A more conventional method could be applied to convey this information, namely, segments for a mark such as a bar or a dot could be provided near the segments for showing the calendar day. This bar or dot would be illuminated, continuously or intermittently, to indicate which of the days is the specially selected day or is the present day. However, if this approach is to be taken, then thirty-one segments must be added, one for each day of the calendar, even when that one mark displays both the specially selected day and the present day. Moreover, if two kinds of marks are to be used so as to clearly distinguish both types of intelligence, that is, the present day and the specially selected day, then sixty-two segments must be added to the front panel. With all of these additional liquid crystal segments, it becomes extremely difficult to arrange all of the transparent electrodes which are required to connect to these segments. Thus, using the multi-flickering mode of this invention is very effective in producing a display which is easy to manufacture and visually acceptable to the user.

Of course, when two days have been picked out for special display, it is inevitable that those two days will coincide, that is the specially selected day and the present day are one and the same. For that condition, a preferential priority for display is built into the timepiece of this invention. In a preferred embodiment of this invention the present day is given preference over the specially selected day for purposes of display when both days coincide. In this instance, if, for example, the first day of the month is the present and the specially selected day, the liquid crystal segments for indicating the first day are illuminated in the flickering mode with a 2 hertz repetition rate. This is the repetition rate associated with the present day.

FIG. 2 is a functional diagram of the driving circuit for the liquid crystal segments which will indicate the specially selected day or the present day for the calendar mode of the front panel. The circuit includes the OR gates 11, 12 and an AND gate 13. The memory circuit 14 stores the specially selected day and the mode signal generator 15 provides two independent outputs, one having a repetition rate of 1 hertz and the other having a repetition rate of 2 hertz. The 1 hertz signal is fed into one terminal of the OR gate 11 and the data for the specially selected day is fed into the other terminal of the OR gate 11. The output S of the OR gate 11 is fed to one input of the AND gate 13. The present day circuit 16 provides data representative of the present day, that is a daily changing output, to one input of the OR gate 12 while the two hertz signal from the mode signal generator 15 is input to the other terminal of the OR gate 12. The output P of the OR gate 12 is fed to the other input of the AND gate 13. The output N of the AND gate 13 is input to the driver 17 which in turn illuminates the display segments 18 on the front panel which together indicate a single number, i.e. a day.

Figure 3A:
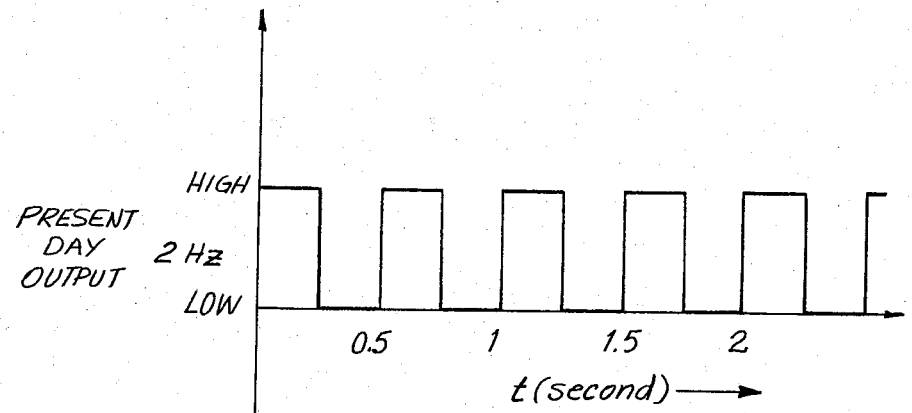
FIGS. 3*a*, 3*b* and 3*c* show wave forms associated with the performance of the functional diagram of FIG. 2.
Figure 3B:
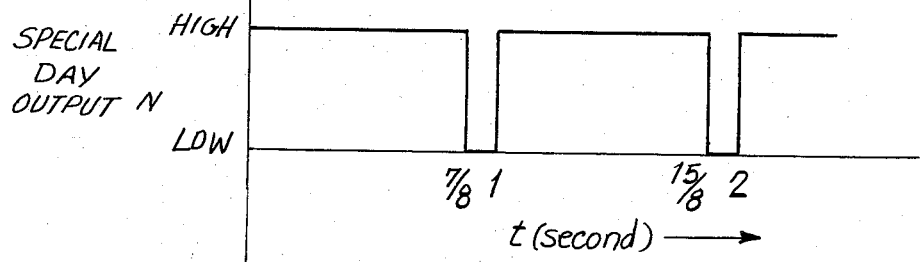
Figure 3C:
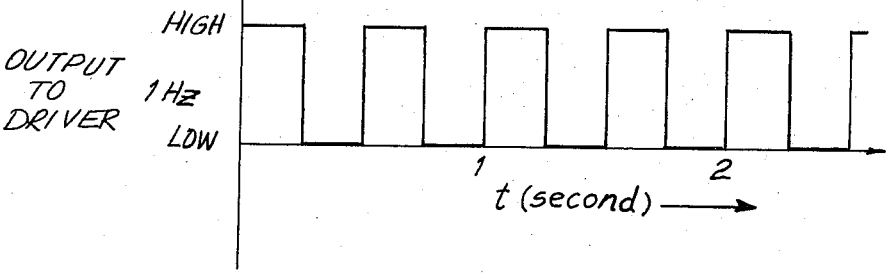

FIGS. 3*a*, 3*b* and 3*c* are waveform diagrams—therefor, diagrams associated with the functional diagram of FIG. 2 which shows high and low circuit outputs in relation to time. Waveform (a) shows a signal having a repetition rate of 2 hertz and a duty cycle of one-half which is used to display the present day. Wave form(b) shows a signal with the repetition rate of 1 hertz and a duty cycle of $\frac{7}{8}$ used for the display of the specially selected day. Note that both signals are synchronized and two present day pulses occur in the same second as one special day pulse. Both signals from the mode signal generator 15 are derived from the standard signals of the electronic timepiece circuits (not shown) used for timekeeping. When the liquid crystal segments are to display the specially selected day, then the output R of the memory 14 is made low. The output of memory 14 is high at all other times. Accordingly, the output S of the age 11 is 1 hertz at the time when the memory 14 provides the low signal for the specially selected day, and the output of the gate 11 is high at all other times.

In a like manner, the output D of the present day circuit 16 is low when the liquid crystal segments are to display the present day, and the output of the present day circuit 16 is high at all other times. Accordingly the output P of the gate 12 is 2 hertz at the time when the present day circuit output is low, and the output of the OR gate 12 is high at all other times. Accordingly, when the memory 14 is low at its output and the present day circuit 16 is high at its output, the output N of the gate 13 is a flickering signal having a repetition rate of 1 hertz and a duty cycle of $\frac{7}{8}$. This intelligence is displayed by the liquid crystal segments 18 for the specially fixed day but there is no flickering indication for the present day. To the contrary, when the present day is to be displayed by the liquid crystal segments 18, the output of the memory 14 is high and the output of the present day circuit 16 is low. The AND gate 13 outputs a signal having a repetition rate of 2 hertz and a duty cycle of $\frac{1}{2}$. The output signal N of gate 13 drives the liquid crystal segments 18 through the driver 17 all in the conventional manner.

When there is coincidence between the present day and the specially selected day, then as seen in the waveform of FIG. 3(*c*), the present day signal of 2 hertz is preferentially displayed. When the liquid crystal segments 18 are to display neither the present day nor the specially selected day by flickering, the output N of the gate 13 is continuously high and the segments are continuously driven without flickering.

A reversal of the priority of preference for display between the present day and that of the specially selected day can be done by interchanging the flickering modes so that the specially selected day is represented by the frequency of 2 hertz and the present day is represented by the frequency of 1 hertz. However, the logic circuitry represented in FIG. 2 by gates 11, 12 and 13 can be changed in order to change the priorities without exchanging the repetition rates of the displays.

Figure 4:
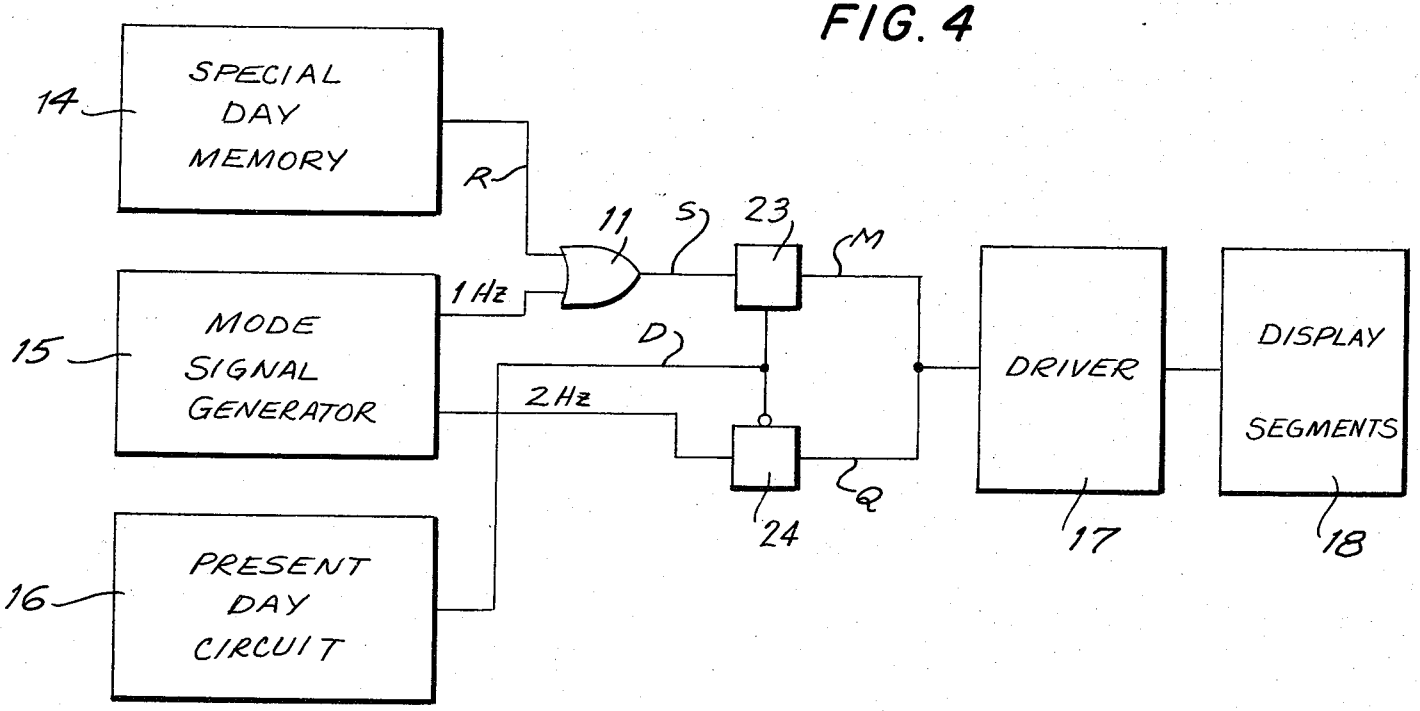
FIG. 4 is an alternative embodiment of a functional diagram of an electronic wristwatch of this invention.

FIG. 4 is the functional diagram of a circuit by which the priority order is reversed from that of the circuit of FIG. 2 without changing the repetition rates and duty cycles associated with each signal. The circuit is similar to that of FIG. 2. The memory 14 provides its output R to the input of the OR gate 11 and the mode signal generator 15 outputs a 1 hertz signal to the other input of OR gate 11.

The output S of the OR gate 11 is input to the gate 23. The output D of the present day circuit 16 is fed into the other input of gate 23. The input S to gate 23 is transmitted as the output signal M when the input D is high. When the input D is low, there is no transmission through the gate 23.

The 2 hertz signal from the mode signal generator 15 is input to gate 24, and an inverted output D from the present day circuit 16 provides a second input to the gate 24. The 2 hertz signal is transmitted to the output Q of gate 24 only when the input D is low. When the input D is high, no signal is transmitted to the output Q of gate 24. The signal M or Q is inputted to the driver 17 which activates the display segments 18 of the front panel. It can also be seen from the diagram of FIG. 4 that any signal D which enables the gate 24 disables the gate 23 and vice versa. Accordingly, at any time that the present day circuit output D goes low in order to make the present day flicker on the front panel, the present day signal will always have priority and be presented as a flickering signal on the front panel. The 1 hertz special day signal can only get through to the driver when the present day circuit 16 output D is high and the special day memory output R is low. Thus the priorities between the functional diagrams of FIG. 2 and FIG. 4 are reversed by adjustment in the logic portion of the circuitry while the other functional elements remain the same.

In summarizing, with either functional diagram, FIGS. 2,4, the present day signal D is displayed in the flickering mode having a repetition rate of 2 hertz whenever there is a coincident demand for both the present day and the special day intelligence.

It should be understood that although two supplemental functions have been added to the information displayed by the front panel in the above example, still more functions may be provided in the flickering modes in alternative embodiments of this invention by using similar interrelated logic circuits and signal generators.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed:

1. Display panel means for an electronic timepiece for displaying information in the form of a plurality of visible indicia, comprising means for flickering at least a selected two of said plurality of indicia, said flickering causing said selected indicia to be alternately visible and invisible, said flickering means being adapted to selectively cause each of at least two of said selected indicia to flicker at a repetition rate different from the repetition rate of the flicker of the other of said at least two of said selected indicia, said flickerings at different repetition rates occurring concurrently on said display panel means for display, said means for flickering including mode signal generating circuits outputting mode signals of different frequencies for flickering each said selected indicia at at least two repetition rates, and further including priority circuits for giving preference to one frequency of said flickering mode signals when more than one flickering mode signal is coincidentally outputted to one of said indicia.

2. The display panel means of claim 1 wherein said indicia are comprised of liquid crystal segments.

3. The display panel means of claim 1 wherein said indicia are comprised of light emitting diode segments.

4. The display panel means of claim 1 wherein said flickerings at different repetition rates have different duty cycles.

5. The display panel means of claim 1 wherein the information displayed on said display panel comprises a calendar including the numbered days of the week, and one of said indicia selected for flickering is the number of the present day and another of said indicia selected for flickering is any specially selected day.

6. The display panel means of claim 5 wherein said present day indicia is flickered at a repetition rate of two hertz with a duty cycle of $\frac{1}{2}$ ON/OFF, and said specially selected day is flickered at a repetition rate of one hertz with a duty cycle of $\frac{7}{8}$ ON/OFF.

7. The display panel means of claim 4 wherein one of said selected indicia flickers with a duty cycle of $\frac{1}{2}$ ON/-OFF and another of said selected indicia flickers with a duty cycle greater than $\frac{1}{2}$ ON/OFF.

8. The display panel means of claim 7, wherein said duty cycle greater than $\frac{1}{2}$ ON/OFF is $\frac{7}{8}$ ON/OFF.

9. The display panel means of claim 8, wherein the repetition rate of said $\frac{1}{2}$ ON/OFF flickering is twice the repetition rate of said $\frac{7}{8}$ ON/OFF flickering.

10. In an electronic timepiece having a front panel for displaying information in the form of a plurality of visible indicia including numbers, letters, and marks, the improvement therein comprising:

means for generating independent signals representative of at least two preselected events;

means for generating independent mode signals, one mode signal being associated with each of said pre-preselected events, each mode signal differing in repetition rate from the other mode signals;

OR gates, the inputs to each OR gate being the independent signal representative of a preselected event and the associated mode signal;

an AND gate, the outputs of said OR gates being the inputs to said AND gate;

display segments forming said indicia, said segments being visible when driven and invisible when not driven;

means to drive said segments, said driving means being actuated by the output of said AND gate, whereby any outputted independent event signal causes said segments to be visible at the repetition rate of the associated mode signal, and a plurality of independent event signals coincidentally outputted causes said segments to be visible at the repetition rate of a preselected one of said mode signals.

11. The electronic timepiece of claim 10 wherein the number of preselected events is two, the associated repetition rates are in the ratio of 2 to 1, the higher repetition rate has a duty cycle of $\frac{1}{2}$ ON/OFF and the lower repetition rate has a duty cycle of $\frac{7}{8}$ ON/OFF, and said higher repetition rate has priority when said two event signals are outputted in coincidence.

12. The electronic timepiece of claim 11 wherein said display segments are light emitting diodes.

13. The electronic timepiece of claim 10 wherein said display segments include liquid crystal segments.

* * * * *